United States Patent [19]

Smith

[11] 4,272,237

[45] Jun. 9, 1981

[54] RADIANT HEATING

[76] Inventor: Thomas M. Smith, 114 Villinger Ave., Cinnaminson, N.J. 08077

[21] Appl. No.: 775,838

[22] Filed: Mar. 9, 1977

Related U.S. Application Data

[63] Continuation-in-part of Ser. No. 701,687, Jul. 1, 1976, abandoned, and a continuation-in-part of Ser. No. 674,409, Apr. 7, 1976, Pat. No. 4,035,132.

[51] Int. Cl.[3] ..... F23D 13/12

[52] U.S. Cl. ..... 431/328

[58] Field of Search ..... 431/7, 8, 328, 329; 126/92 AC, 92 B; 228/183

[56] References Cited

U.S. PATENT DOCUMENTS

| | | | |
|---|---|---|---|
| 2,227,899 | 1/1941 | Grubb | 431/328 |
| 2,921,176 | 1/1960 | Scofield | 431/328 |
| 3,008,513 | 11/1961 | Holden | 431/328 |
| 3,824,064 | 7/1974 | Bratko | 431/328 |
| 3,912,443 | 10/1975 | Ravault et al. | 431/328 |
| 3,963,414 | 6/1976 | Jensen | 431/329 |
| 4,035,132 | 7/1977 | Smith | 431/7 |

*Primary Examiner*—Carroll B. Dority, Jr.
*Attorney, Agent, or Firm*—Connolly and Hutz

[57] ABSTRACT

Improved gas-fired radiant heater has porous refractory panel mounted by its edges on a support to define a gaseous combustion mixture plenum from which the mixture flows through the panel to burn at its outer face, and a conduit for non-combustible gas extends along the margin of the panel and discharges the non-combustible gas through the panel all along its margin to keep the combustion mixture from escaping through the panel edges where burning can damage the panel. No further sealing of the panel margin is needed, but the sealing is effected with less of the non-combustible gas if the panel edges are compressed so as to reduce their thickness about 10%. One or more of the margins of a rectangular panel can be arranged as a depending flange with its mounting at least partially recessed so that two or more panels can be juxtaposed at such margins to form an effectively continuous radiating surface of relatively large size. The air seal construction also makes such heaters very practical for firing house heating furnaces.

10 Claims, 14 Drawing Figures

RADIANT HEATING

This application is in part of continuation of applications Ser. No. 701,687 filed July 1, 1976 (subsequently abandoned) and Ser. No. 674,409 filed Apr. 7, 1976 (U.S. Pat. No. 4,035,132 granted July 12, 1977).

The present invention relates to gas-fired radiant heaters and to equipment with which they are used. Such heaters are described in the above-identified parent applications as well as in the patents referred to therein, and the contents of both applications are hereby incorporated herein as though fully set forth. As noted such a heater utilizes a panel of interfelted ceramic fibers, a gaseous combustion mixture being continually passed through the panel and burnt at the panel face from which it emerges. The combustion takes the form of a flame that extends over the entire area of the face from which the combustion mixture emerges, the flame length being very small so that the surface fibers at the flame are heated to red heat or hotter and form an essentially continuous wall of heat that makes a very effective heat radiator. By increasing or decreasing the rate of flow and/or composition of the combustion mixture, the temperature of the heated fibers can be controlled.

Among the objects of the present invention is the provision of novel heater structures that are simpler to construct or provide improved operation or both.

The foregoing as well as additional objects of the present invention will be more fully understood from the following description of several of its exemplifications, reference being made to the accompanying drawings in which.

According to the present invention as gas-fired radiant heater of the foregoing type having a porous refractory panel through the thickness of which a combustion mixture is passed and which is mounted by its edges, has a narrow stream of non-combustible gas such as air passed through the panel all along its edges, in an amount that without further help keeps the combustion mixture from escaping through the panel edges. The porous refractory panel can be flat, convex, concave, cup-shaped, hat-shaped, or have any other desired configuration.

An even greater simplification of the foregoing heater construction and operation is effected by squeezing the panel margins so that they are compressed at least about 10% from their umcompressed thickness, inasmuch as this simple expedient also helps reduce the escape of combustion mixture through the panel edges. When combining a marginal gas stream seal with the edge compression, very effective edge sealing is accomplished with only a fraction of the flow of non-combustible gas otherwise required. With either arrangement however, no other assistance is needed to seal against edge leakage of combustion mixture, and edge impregnation as well as edge wrapping of the panel is completely dispensed with.

Figure 1:
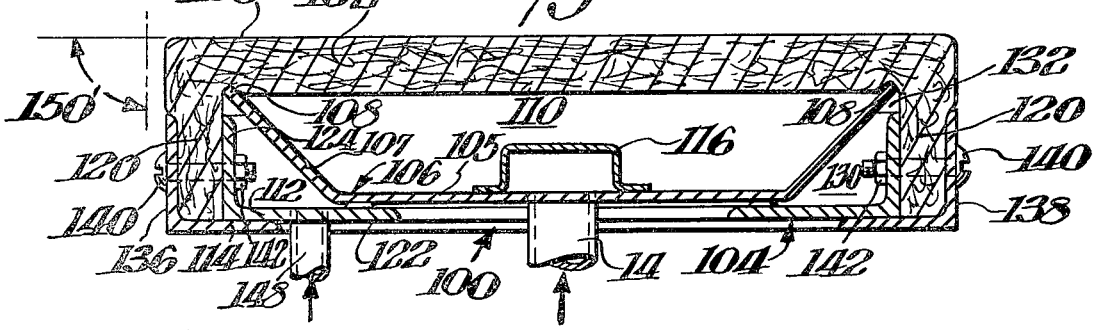
FIG. 1 is a sectional view of a gas-fired radiant heater according to one aspect of the present invention.

FIG. 1 illustrates a heater 100 with the improved edge sealing. Heater 100 has a cup-shaped panel 102 of interfelted refractory fibers as described in Ser. No. 701,687, now abandoned, clamped by its edges around a support assembly 104 made of stainless steel or other metal members shaped from relatively thin stock, about 1/16 inch thick. A central dish 106 has a floor 105 and inclined walls 107 with raised edges 108 against which the panel 102 is pressed to define a combustion mixture plenum 110. Outer face 103 of panel 102 is of rectangular shape, and so is plenum 110.

Secured to the outer margin of the floor 105 of dish 106 is a series of angles two of which are shown at 112, 114, defining a rectangular frame against which the edges 120 of panel 102 are fitted. These angles are illustrated as having horizontal webs 122 welded or brazed to the floor of dish 106, and vertical webs 124 that approach but do not quite reach the dish edges 108. The frame angles define with dish walls 107 an outer plenum 130 that encircles combustion mixture plenum 110 and has a discharge slot 132 that is engaged by the margin of panel 102. The frame members are mitered or otherwise interfitted at the corners of the frame to minimize, or completely seal the outer plenum against, leakage in those locations. Supply nipples 146, 148 are fitted in openings in the floor 105 and one or more of the frame angles 112, to deliver, respectively, combustion mixture and non-combustible gas. Baffles such as the U-shaped deflector 116 can also be provided to help more uniformly distribute the incoming gases. Inasmuch as air is generally the non-combustible gas that flows through plenum 130, a little leakage from that plenum doesn't do any particular harm other than consume a little excess air.

Anchoring of panel 102 in place is shown as effected with the help of a series of four or more clamping angles 136, 138, clamping the panel edges 120 against the frame angles, with the help of screws 140 that penetrate through aligned openings in the angles and are threaded into self-locking nuts 142 mounted in webs 124 as by securing clips or welding. The screws which need be no thicker than about 3/16 inch, are readily pushed through the edges of the panel without seriously damaging the panel, and any damage that might promote gas leakage is more than compensated by drawing up the clamps sufficiently to compress the panel edges. Standard panels have a wall thickness of about 1⅛ inches and an interfiber spacing such that more than half that thickness is fiber and binder, so that compressing the edges to reduce the overall thickness only about 10% sharply reduces the air space between fibers and greatly limits leakage.

However very effective panels of interfelted fibers can be made by needling a mat of such fibers without the help of binder. Such needled panels can be extremely pliable, as compared to molded binder-containing mats that are stiff like boards, and can have their edges compressed down to as little as about 30% of their compressed thickness. Even compressing such edges that are originally about one inch thick down to about $\frac{3}{8}$ inch provides an extremely effective back-up for the air seal.

For such pliable panels it is preferred that the edge compression be down to about half the original thickness, or less. If desired however a pliable panel can be stiffened over its edges alone, or over its entirety, as by impregnating it with a water solution of starch or the like. In such stiffened condition, the degree of edge compression can be reduced.

To reduce any effect that the compression may have in breaking panel fibers that are binder-impregnated, the panel edges to be compressed are first dipped in water or other solvent for the binder carried by the fibers. Such wetting makes the edges more readily deformable so that the compressing is easily effected without seriously stressing the clamping structures. To assure uniformity of compression of board-like panels, the screws 140 are no more than about 8 inches apart when the angles have the above-noted wall thickness. Where the heaters are operated in confined spaces so that the clamping angles are subjected to considerable reflected heat, it is helpful to cut slots about six inches apart through the vertical webs of those angles, to allow for thermal expansion and contraction without distortion of the support. Such slots need only be about 20 mils wide, but can be omitted where the clamping angles do not engage each other at the corners of the frame so that expansion is possible at those corners.

A feature of the heater construction of FIG. 1 is that a plurality of such heaters can be juxtaposed to make an effectively continuous radiant heating assembly that covers an extended area. Thus individual heaters are conveniently made with rectangular heater faces about one foot by two feet in size, larger sizes of stiff board-like panels being somewhat awkward to manufacture because the molding and handling is more difficult. However by making the smaller sized panels so that their edges 120 are bent down at least about 90 degrees from the plane of the panel body, considering such edge as a flange bent down from a flat sheet, and locating the edge mountings so they are at least partially inboard of the outer face of that flange and not projecting beyond that face more than about 5 millimeters, they juxtapose in a very desirable manner as illustrated in FIG. 2.

Figure 2:
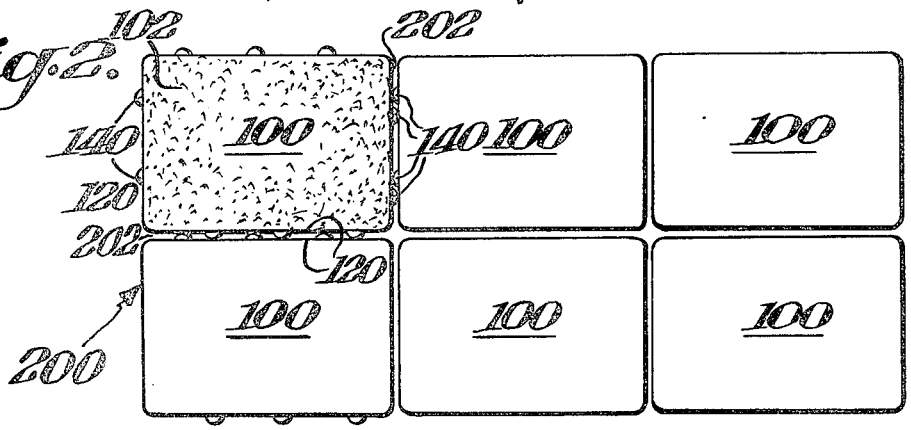
FIG. 2 is a plan view of an assembly of heaters of the type illustrated in FIG. 1.

In FIG. 2 an assembly 200 of individual heaters 100 is made with the adjacent faces of their panel edges 120 about 3 millimeters apart as indicated at 202. The margins of the panel faces 102 can be made so that they have an essentially zero radius of curvature where they bend into the edges 120, but it is sometimes simpler to make them with a radius of about $\frac{1}{8}$ inch, and the foregoing 3 millimeter spacing of such rounded corners does not significantly detract from an effectively continuous heater surface junction, particularly where the combustion mixture is arranged to burn over the entire rounded corner. Increasing the spacing from about 3 millimeters to about 5 millimeters does make a significant discontinuity in the radiation uniformity but this can generally be tolerated. Spacings up to about $\frac{1}{4}$ inch or even up to about $\frac{1}{2}$ inch can also be used.

While the clamping screws 140 are shown as having round heads and thus project out the furthest from the outer faces of the refractory panel edges, such projection is not a problem so long as it is not over the 5 millimeter limit noted above, or the preferred 3 millimeter limit. These screws can be in unsymmetrical locations along each edge, so that the screws on one heater are offset from the screws of an adjacently positioned heater, as also illustrated in FIG. 2. Indeed the round-head screws can be replaced by socket-head screws which project a trifle more but are easier to install during manufacture. Flat-head screws can alternatively be used with the screw openings in the clamping angles countersunk so that the screw heads do not project beyond those angles, if minimum or zero spacing 202 is desired.

The burner construction of FIG. 1 can also have panels of the pliable needled type described above. Such a pliable panel behaves very much like a blanket, and can have its edges folded and tucked in place between the side anchorage members. Because of their high pliability, the corners of such panels will squeeze into shape, although it may be helpful to cut away all excess corner material, and to even notch out some of the panel corners to make it easier to clamp these panels into place. It is preferred to confine any notching to portion of the corners covered by the anchorage members so as to reduce the leakage of gas at the notches.

It is not necessary to have the entire margin of each refractory panel 102 flanged over as at 120. Thus each of the panels in FIG. 2 has at least one margin that is not juxtaposed to another panel, and some have two such non-juxtaposed margins. Where only two panels are to be juxtaposed, each can have only one margin provided with a flanged-over edge 120, in which event the remaining three margins can have simple constructions as shown in the flat panel exemplifications in the parent applications as well as in FIGS. 3 and 4.

Very close juxtaposition can also be provided by molding or shaping juxtaposed edges 120 so that they are bent down more than 90 degrees from the horizontal as measured by the angle 150 in FIG. 1. A panel can thus be molded around a suitably shaped molding screen with as many as three of its four sides having flanged edges bent as much as 100 or 110 degrees measured at angle 150, and the thus molded panel can then be slipped sideways off the mold in the direction away from its fourth side. Where only one flanged edge margin is desired, it can be made when molding the panel, or by bending down the edge of a flat-molded panel, after that edge is softened by wetting.

Figure 3:
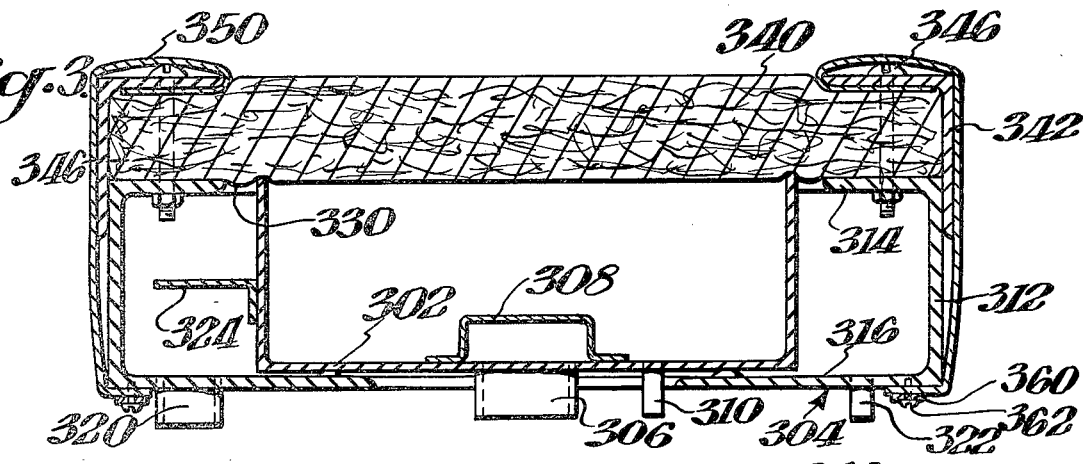
FIG. 3 is a sectional view similar to FIG. 1 of a modified heat construction pursuant to another aspect of the present invention.
Figure 4:
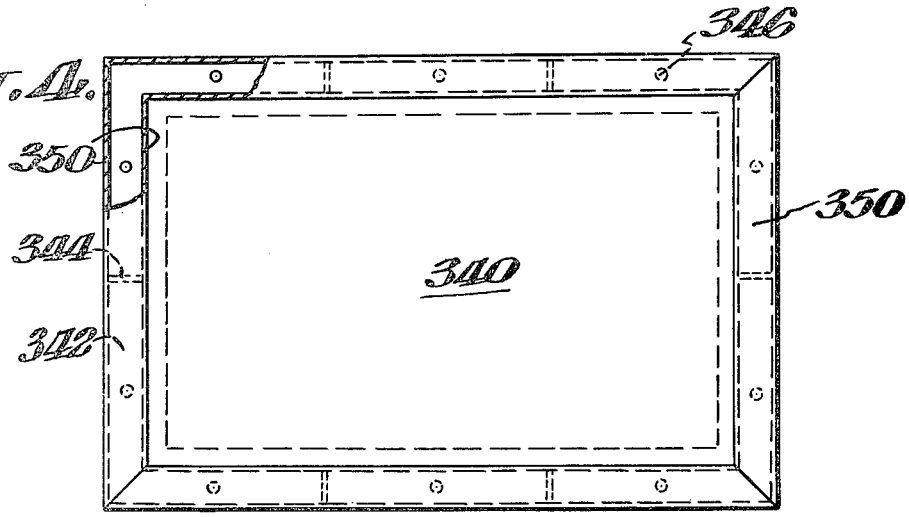
FIG. 4 is a plan view of the heater of FIG. 3.

The construction of FIGS. 3 and 4 is one for flat heater panels easily manufactured from readily available sheet metal. It has a panel support which is a welded-together assembly of a rectangular plenum box 302 and a hollow-centered rectangular encircling plenum tube 304. Plenum box 302 is conveniently prepared by suitably notching out the corners of a rectangular sheet, then bending up the four wings thus formed, and welding the resulting corners gas tight. A hole can be punched in the floor of the box to receive a PTM half close nipple 306 also welded on gas tight. A baffle 308 can also be spot welded over the hole to distribute the combustion mixture fed through it. If desired an extra tap 310 can also be provided at a second hole in the box floor, for a pressure gage or the like.

Tubular plenum 304 is easily made from sheet metal bent into the shape of a channel having a web 312, and unequal flanges 314, 316. The channel is cut into four lengths each of which is mitered and then welded together gas tight, if desired. The tubular plenum can then be affixed to the plenum box as by spot welding the flanges 316 to the floor of the box. A gas inlet 320 in the form of half a close nipple can be affixed to the tubular plenum, along with an extra tap 322 in the same manner as for the box plenum, and a baffle 324 can be fixed over inlet 320 by spot welding to either the outside of the box plenum or the inside of the tubular plenum.

A slot 330, preferably ¼ inch wide, encircles the top of the box plenum. The refractory matrix 340 is clamped in place by a clamping frame 342 of angular section as illustrated in FIG. 3 and having slits 344 cut in the web overlying the face of the panel as shown in FIG. 4. The slits can be about 8 inches apart and preferably 1/16 inch wide to take care of the most severe thermal conditions. The clamping frame is secured by screws 346 as in the construction of FIG. 1, although sheet metal screws can be used instead in either construction, in which event the nuts can be omitted and if desired locking washers fitted under the screw heads.

In severe thermal conditions, such as firing face down or when firing directly at opposing burners, it is desirable to insulate the clamping frame 342 from the radiated and convected heat by over-wrapping with a high temperature insulating material such as mineral fibers felted or needled in blanket form. FIG. 3 shows a fiber blanket 350, approximately ½-inch thick, clamped and compressed between clamping frame 342 and refractory matrix 340, wrapped around the clamping frame 342 and web 312 and secured to flange 316 by means of clamp 360 and sheet metal or other screws 362. The fiber blanket 350 insulates the clamping frame from convected heat and its pure white color reflects some radiated energy from opposing burners making the system more efficient. In very high ambient operating conditions it may be desirable to completely wrap the non-radiant surfaces of the burner of FIG. 3 with the fiber blanket.

Figure 4A:
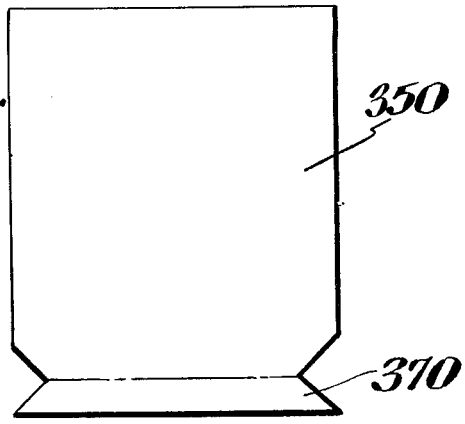
FIG. 4A is a plan view of a component of the structure of FIGS. 3 and 4.

FIG. 4A shows the fiber blanket 350 as prepared for installation, having a tuck-in margin 370 which is inserted under the face of clamping frame 342.

In less severe applications it may be desirable just to cover the face of 342 and hold the blanket in place with the screws 346 and washers under their heads.

Figure 5:
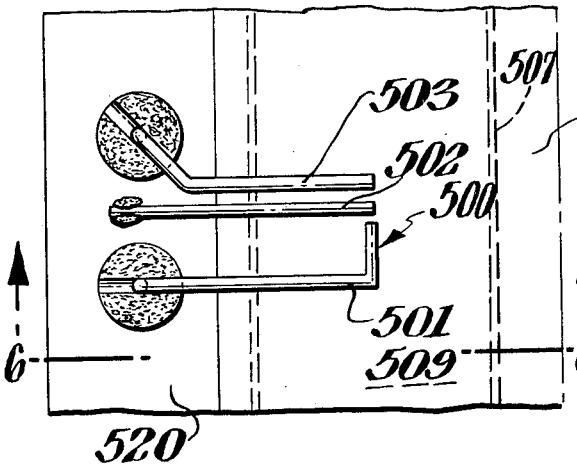
FIG. 5 is a broken-away plan view of a portion of a heater showing a detail feature suitable for use according to the present invention.
Figure 6:
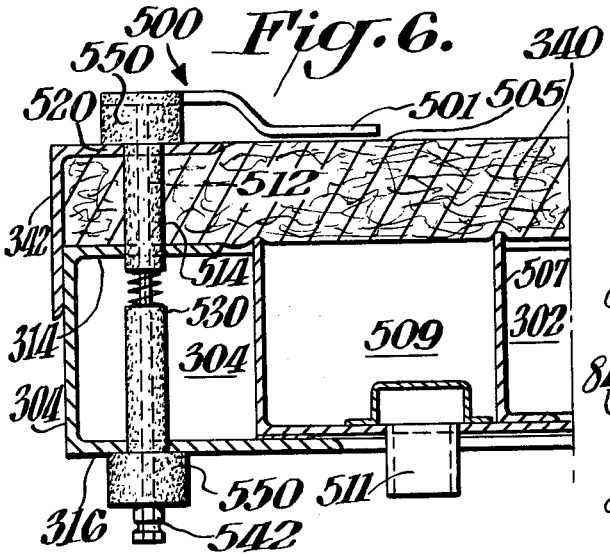
FIG. 6 is a sectional view of the construction of FIG. 5, taken along line 6—6.

The radiant heaters of the present invention can be equipped with automatic igniters such as electric spark igniters or pilot lights. FIGS. 5 and 6 show a particularly desirable automatic igniter construction fitted into a heater of the type illustrated in FIGS. 3 and 4. A standard combination 500 of spark rod 501, ground rod 502 and flame-checking rod 503 is mounted so that the rods are generally parallel to and about 1/16-inch above the outer face 505 of the porous refractory panel 340. Below the opposite face of the panel underneath the rod assembly, the box plenum is provided with a partition 507 that isolates a chamber 509 from the remaining space in the box plenum, and the chamber is fitted with its own supply connector 511 to receive a separate combustion mixture.

The spark rod 501 and flame-checking rod 503 are each housed in two identical insulators 550 which go through aligned openings punched in the top flange 520 of the clamping frame 342 and in the flanges 316 and 314 of plenum 304 as shown in FIG. 6. Ground rod 502 is welded or brazed to flange 520. The ends of rods 501 and 503 projecting out through flange 316 are threaded to each accept a connector 542 which holds them in place and provides a ready connection for necessary wiring.

The construction of FIGS. 5 and 6 is operated to start the burners using a safety check. A separate pilot combustion mixture is first started into chamber 509 and at the same time the spark rod is electrically energized to begin sparking. If the flame rod does not sense a flame within a short period of time, such as 10 to 30 seconds, the flow of combustion mixture can be automatically cut off and the starting sequence must then be manually recycled, preferably after the combustion mixture flow is checked as by purging chamber 509. When the starting sequence causes ignition of the separate combustion mixture, the flame-checking rod 503 senses the ignition and opens the valve that feeds the main combustion mixture into plenum 302 which is then ignited by the flame at chamber 509.

By using a small chamber 509 with a low BTU/hour input for the automatic ignition test, the danger of explosion at ignition is minimized. A chamber volume of about 100 cubic centimeters or less is very effective for this purpose.

The pilot combustion on the radiating surface of the panel contributes to the overall radiation.

The spacing of the rod assembly from the refractory panel is preferably kept very small so that the rods do not interfere with placing the radiating surface close to the material being irradiated, such as a moving textile web that is being dried. Because the effectiveness of the heater increases when brought close to the material treated, the spacing of the panel from that material is sometimes arranged to be as little as two inches or even less.

Figure 7:
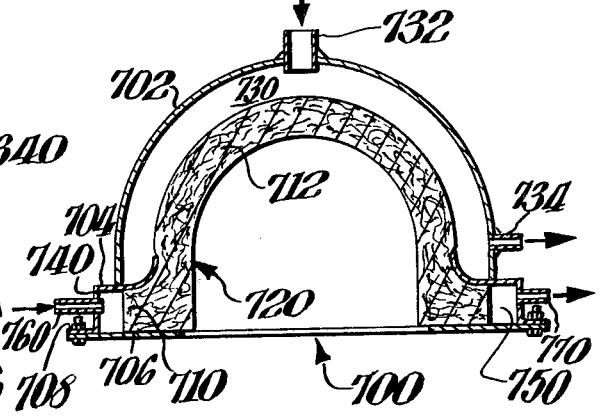
FIG. 7 is a sectional view of a different heater construction pursuant to a further aspect of the present invention.

FIG. 7 illustrates a radiant heater 700 of the present invention particularly adapted for the sealing of metal tubes in a metal sheet in accordance with the technique described in Ser. No. 701,687. Heater 700 has a dome-shaped holder 702 welded gas-tight to a support ring 704 that is shaped to fit and receive the brim 710 of a hat-shaped refractory ceramic panel 720. The crown portion 712 of the panel is thus held in spaced relation to the dome-shaped holder 702 to define a plenum 730 for the combustion mixture to be burned on the concave surface of the crown 712. An inlet 732 and pressure gauge tap 734 are shown as fitted to the holder 702.

The brim of panel 720 is shown as clamped against support ring 704 by a clamping ring 706 which is bolted to an extension 708 of support ring 704 and is offset from it to form a cylindrical wall 740 that defines an annular plenum 750 for the non-combustible gas. If desired the offset can be made integral with the clamping ring so that support ring extension 708 can be in the general plane of the main portion of the support ring. Alternatively wall 740 can be divided into upper and lower short cylinders separately integral with the separate rings. An inlet 760 and a pressure gauge tap 770 are also provided for the annular plenum.

The radiant heater 700 can directly replace the corresponding heater in FIG. 1 of Ser. No. 701,687, even though heater 700 has only one combustion zone. Non-combustible gas pumped into plenum 750 of heater 700 flows through the brim 710 of the porous refractory panel 720 and keeps the combustion mixture fed through plenum 730 from reaching the lowest portion of the internal surface of the panel where it is aligned with plenum 750. No external cooling coil or jacket is needed for the heater 700, inasmuch as the non-combustible gas emerging from the lower portion of the interior of the panel flows outwardly along the bottom of clamping ring 706 and keeps it as well as the associated metal parts sufficiently cool. Holder 702 as well as the remaining members that hold panel 720 can all be made of aluminum about 60 mils thick.

Another feature of the present invention is that the heaters with the air seal construction are particularly suited for use in house hot air and/or hot water heating furnaces. The air seal effectively prevents diffusion of the combustion mixture to edge locations where it can burn at a low feed rate and thus gradually burn back deeply into the binder holding the refractory fibers, eventually creating a line of weakness at which an unneedled panel tends to readily break. Indeed the burn-back can sometimes burn back far enough to cause ignition within the mixture plenum itself, rendering the heater unsuited for continued operation. The edge seal construction of the present invention accordingly provides a very long life for the refractory panel, and is also so simple that it is inexpensively constructed and thus more attractive for relatively small home-type equipment.

Figure 8:
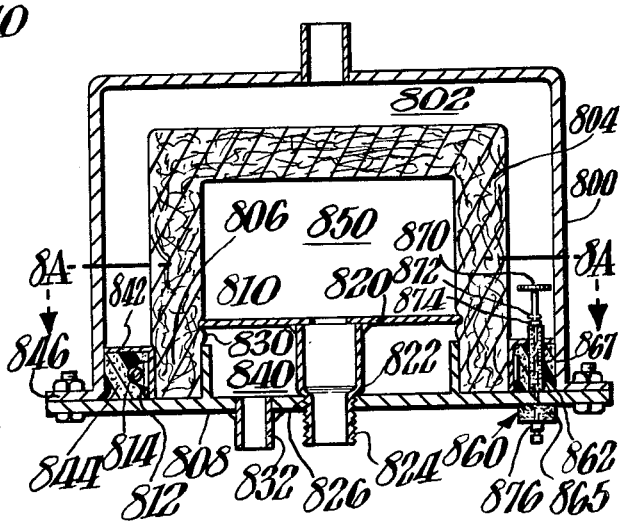
FIGS. 8 and 8A are sectional views of a heater construction typifying yet another aspect of the present invention.
Figure 8A:
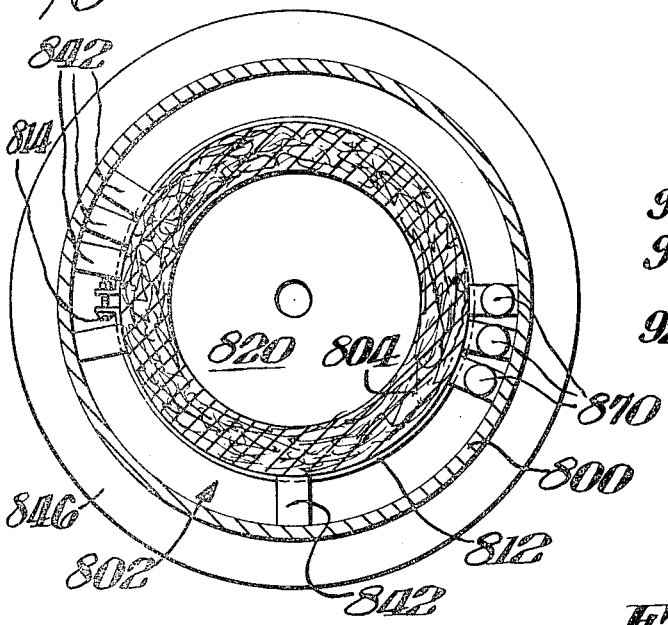

FIGS. 8 and 8A show a hot air heat exchanger construction for house heating pursuant to the present invention. Here a cylindrical heat exchanger 800 has a hollow interior 802 in which is received a fibrous panel 804 also of generally cylindrical shape. The panel has an open end 806 clamped to a mounting plate 808 as by means of a rib 810 formed or welded on the plate and around which the panel end is squeezed by a split sheet metal strap 812 whose ends can be pulled together by a tightening screw 814.

Before the panel is fitted in place a partition disc 820, held on a tubular support 822 having an externally threaded extension, is mounted on mounting plate 808 which has a threaded aperture 826 that threadedly receives the threaded extension 824.

Partition disc 820 has its periphery located just above the edge of rib 810, to define a marginal slot 830 for discharge of a sealing gas stream through the marginal portion of the panel 804. An inlet nipple 832 provides for the delivery of the sealing gas stream of the sealing plenum 840 below partition disc 820. Extension 824 provides for the supply of combustion mixture to the plenum 850 above the partition disc.

Strap 812 is also shown as carrying a ring of outwardly-extending ears 842 that help retain a mass of insulation packing 844 fitted around the open end of panel 804 when mounting plate 808 is brought into engagement with the mouth 846 of heat exchanger 800. Some of those ears are also perforated to receive an ignition and test assembly 860 shown in the form of a series of ceramic tubes 862 each having an enlarged head 865 and threaded into aligned openings in the mounting plate. Through the passageway in each ceramic tube there penetrates a rod 867 having a disc-shaped inner end 870 and staked as at 872 so that it is appropriately located with respect to the ceramic tube. A washer 874 can be slipped over each rod before it is inserted in the ceramic tube, to furnish better positional coaction with the tube and the staking. The outer edge of each rod can be threadedly engaged to a mounting tip 876.

The discs 870 of each rod are arranged so that they are in edge-to-edge opposition suitable for sparking and for flame detection, as described in connection with FIGS. 5 and 6.

The outside of heat exchanger 800 can be located in the circulating air plenum of a standard house heater, or if desired in a water tank containing water to be heated. This heat exchanger can be made of metal or even of glass, borosilicate glass being particularly suited when the heat exchanger is used to heat water. Water to be heated in this way can be colored with dyes for example, to better absorb radiant energy transmitted through a transparent heat exchanger. Metal heat exchangers are desirably ribbed to increase their effective surface area and thus increase their heat transfer to surrounding air or the like.

Another feature of the present invention is the ability to use an inert or reducing gas to seal the combustion mixture on its way through the porous refractory panel. Thus the sealing gas can contribute to make the burnt combustion mixture provide an atmosphere of exceedingly low oxygen content, or even of strongly reducing ability as for example by reason of a significant hydrogen content.

Figure 9:
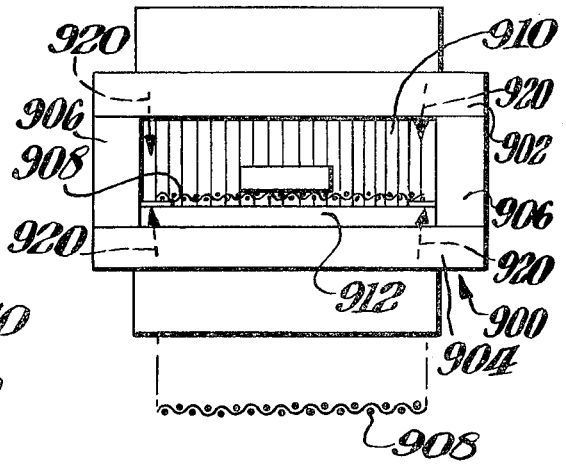
FIGS. 9, 10 and 11 are views of still further embodiments of the present invention.

FIG. 9 shows an annealing tunnel furnace 900 having upper and lower radiant heaters 902, 904 facing each other and held in fixed relation by side blocks 906 of thermal insulation. A wire mesh conveyor 908 is arranged to slide through the furnace interior to carry workpieces that are to be annealed or brazed. A strip curtain 910 closes off the entrance to the furnace above the conveyor, the portion of the entrance below the conveyor being closed by a one-piece wall 912.

The heaters 902, 904 are operated in the manner described above, except that the sealing gas streams, indicated by arrows 920, can be cracked ammonia, or a propane-nitrogen mixture, or pure propane or the like. With such sealing gases, it is preferable to adjust the combustion mixtures so that they have little or no surplus oxygen. The furnace interior then becomes a very effective reducing atmosphere that will prevent oxidation of the workpieces and even reduce any oxidation present on those pieces when they are introduced into the furnace. Notwithstanding the strongly reducing character of the furnace interior, the burning of the combustion mixture takes place very effectively to provide radiation at temperatures at least as high as red heat.

Figure 10:
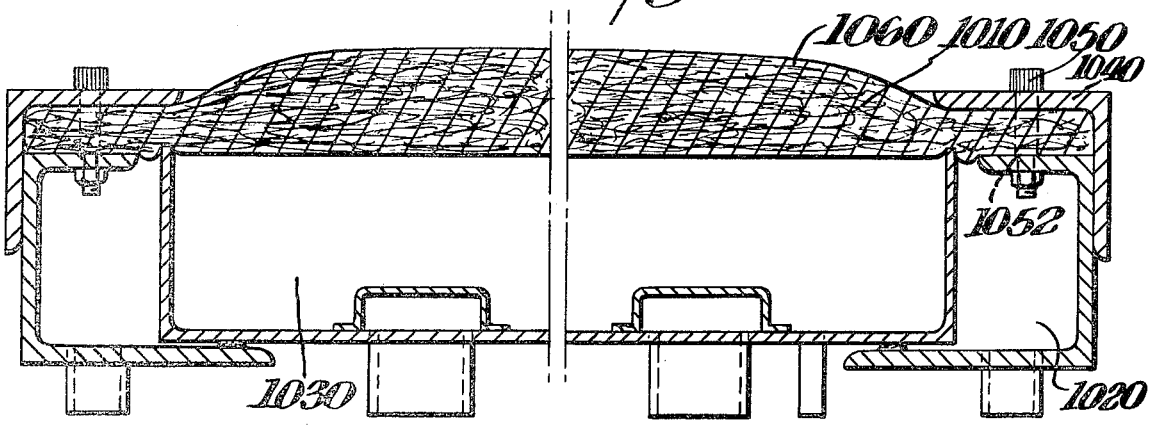

The needled ceramic fiber panels described above are conveniently manufactured in very long lengths, as long as 25 feet or even longer. Such panels are particularly suited for use with very long radiant heaters, and a construction of this type is shown in FIG. 10.

Here a ceramic fiber panel 1010 about fifteen feet long and about one foot wide, has its edges clamped against the face of an air seal plenum 1020 surrounding a rectangular combustion mixture plenum 1030. Angles 1040 compress and clamp the panel edges, being drawn against the air seal plenum face by screws 1050 that can be fitted with shoulders 1052 against which they can be tightened at relatively high torque with a minimum of attention.

A panel 1010 that is not stiffened with binder or the like, will belly out as shown at 1060, under the influence of the pressure in plenum 1030. This is not particularly harmful, and is in some respects desirable because it reduces the heat radiation from the face of the panel to the clamping angles.

The bellying action can be reduced by pretensioning the panel when it is mounted.

Figure 11:
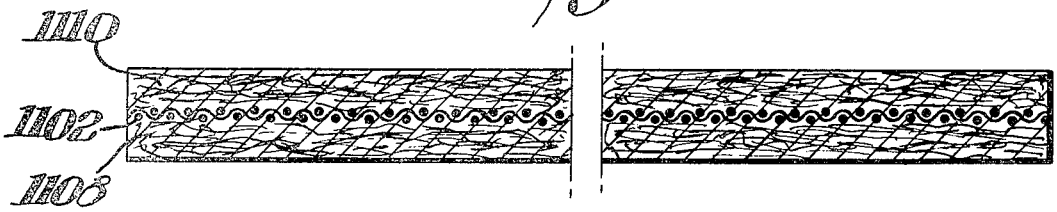

Another technique for stiffening a pliable panel is to needle it around a stiffener as shown in FIG. 11, for example. In this construction a wide mesh metal screen 1102 is laid in between two layers 1108, 1110 of ceramic fibers, and a needling operation then performed to interfelt the two fiber layers.

Figure 12:
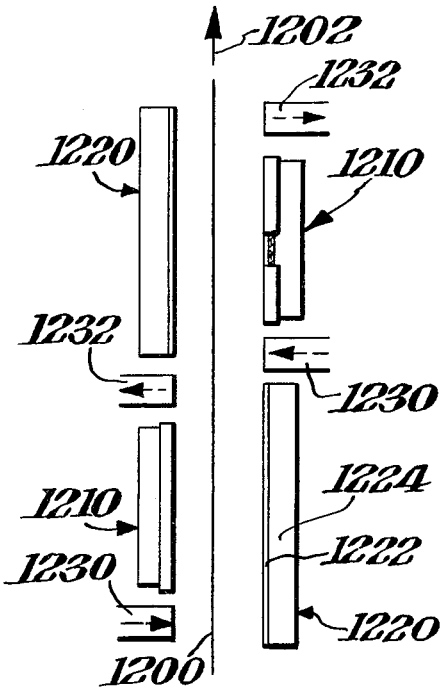
FIG. 12 is a vertical sectional view partly diagrammatic of a heating arrangement pursuant to the present invention.

FIG. 12 shows a particularly effective heating arrangement for heat treatment of a moving web 1200, such as textile drying and curing or paper processing, the direction of movement being shown by arrow 1202. In this arrangement a series of burners 1210 face the moving web adjacent each other on opposite sides of the web. Immediately facing each burner 1210 is a re-radiator 1220 having a very thin layer of heat-absorbing material such as oxidized stainless steel 1222, backed by a high temperature insulator 1224 such as refractory felt. The re-radiators are preferably substantially wider than the burners and in use the heat absorbing layer 1222 absorbs substantial quantities of heat which penetrate through web 1200 so that the layer becomes quite hot and re-radiates heat back to the web 1200. To improve the drying or gas-removing effect of the heat treatment process, intake and exhaust ducts 1230 and 1232, respectively introduce streams of poorly saturated air adjacent the location where the web approaches the burner, and withdraw more saturated air adjacent the locations where the web leaves the burner. To further improve the efficiency of this system, heat from the withdrawn air can be used to preheat the incoming poorly saturated air.

Obviously many modifications and variations of the present invention are possible in the light of the above teachings. It is, therefore, to be understood that within the scope of the appended claims the invention may be practiced otherwise than as specifically described.

What is claimed:

1. In a gas-fired radiant heater having a porous refractory mat at the surface of which a gaseous combustion mixture is burned, mounting means holding the mat edges against a plenum box to define a combustion-mixture supply plenum chamber, the improvement according to which a means forming a gas-supply conduit encircles the plenum box alongside said edges and has means forming a gas discharge opening against which the margin of the mat is positioned and from which a separate stream of non-combusting gas can be passed through the mat all along its periphery and the means forming the gas-supply conduit encircling the plenum is defined between the encircled plenum box and encircling interconnected lengths of open members having angular cross-sections and secured to the back of the plenum.

2. The combination of claim 1 in which the open members are channels having one side wall wider than the other.

3. In a gas-fired burner having a combustion mixture chamber, a gas pervious matrix disposed over said chamber to define a burner face, a holding frame having a flange engaging the outer face of said matrix around its marginal edges, and a gas plenum adjacent said chamber, the improvement wherein the burner has gas-directing means directing cooling gas from the gas plenum to the underside of said frame flange through the marginal portions of said matrix.

4. In a gas-fired radiant heater having a porous refractory mat at the surface of which a gaseous combustion mixture is burned, mounting means holding the mat edges against a plenum box to define a combustion-mixture supply plenum chamber, the improvement according to which a means forming a gas-supply conduit encircles the plenum box alongside said edges and has means forming a gas discharge opening against which the margin of the mat is positioned and from which a separate stream of non-combusting gas can be passed through the mat all along its periphery, the mat being compressible, the mounting means squeezing the mat edges outboard of the gas discharge opening to reduce the mat-edge thickness at least 10% and limit the escape of non-combustible gas out through the ends of the mat to a fraction of what would otherwise escape.

5. The combination of claim 4 in which the compressible mat is a needled mat of fibers.

6. In a gas-fired radiant heater having a porous compressible ceramic fiber mat and clamping means holding the mat edges against an open box so that the mat defines with the box a combustion mixture plenum from which gaseous combustion mixture is passed through the thickness of the mat to emerge from the exposed mat face and burn at that face, the improvement according to which a second plenum of tubular configuration surrounds the combustion mixture plenum and has a face engaged by the mat edges, the clamping means includes hold-down flanges engaging the mat edges and squeezing those edges against said second plenum face, slot means extends along the face of the tubular plenum for discharging a narrow stream of non-combusting gas from that plenum through the thickness of the mat adjacent its edges around the entire mat periphery to confine the combustion mixture, and the mat edge squeezing reduces the thickness of the mat edges beyond the slot means at least 10% to restrict the escape of the non-combusting gas laterally through the ends of the mat.

7. The combination of claim 6 in which there is no other barrier to the lateral escape of gas, and the clamping means includes fasteners that penetrate through the squeezed mat edges and clamp the hold-down flanges to the face of the tubular plenum.

8. The combination of claim 7 in which the fastener members are screws no thicker than 3/16 inch and they also penetrate through screw receiving openings in the flanges and in the face of the second plenum.

9. The combination of claim 4 in which the mat edges have no added sealant or barrier and in unsqueezed condition the burner edges are as porous as the remainder of the mat.

10. The combination of claim 6 in which the burner carries ignition means on the outer face of a hold-down flange, and connection elements for the ignition means penetrate through the flange and through the squeezed matrix edge.

* * * * *